US005857138A

United States Patent [19]

Iida et al.

[11] Patent Number: 5,857,138

[45] Date of Patent: *Jan. 5, 1999

[54] IMAGE FORMING APPARATUS CAPABLE OF DOUBLE-SIDED COPYING AND PROVIDED WITH INTERMEDIATE TRAY ON WHICH FEED DIRECTION OF COPY SHEET IS INVERTED

[75] Inventors: Kazumi Iida; Akira Fushida; Takaichi Kitagawa, all of Osaka, Japan

[73] Assignee: Mita Industrial Co., Ltd., Osaka-fu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 775,117

[22] Filed: Dec. 30, 1996

[30] Foreign Application Priority Data

Jan. 10, 1996 [JP] Japan ..... 8-002684
Oct. 2, 1996 [JP] Japan ..... 8-262102

[51] Int. Cl.[6] ..... G03G 15/00

[52] U.S. Cl. ..... 399/402; 271/3.03; 399/401

[58] Field of Search ..... 399/381, 401, 399/402, 397; 271/3.03, 3.05

[56] References Cited

U.S. PATENT DOCUMENTS

| | | | |
|---|---|---|---|
| 4,908,673 | 3/1990 | Muramatsu | 399/402 |
| 5,020,788 | 6/1991 | Hatano et al. | 271/3.05 X |
| 5,155,540 | 10/1992 | Yamada et al. | 399/402 |
| 5,604,577 | 2/1997 | Wakuda et al. | 271/3.03 X |

FOREIGN PATENT DOCUMENTS

| | | |
|---|---|---|
| 3-279152 | 12/1991 | Japan . |
| 6-3894 | 1/1994 | Japan . |
| 7-120985 | 5/1995 | Japan . |

*Primary Examiner*—Arthur T. Grimley
*Assistant Examiner*—Quana Grainger
*Attorney, Agent, or Firm*—Jordan and Hamburg

[57] ABSTRACT

An image forming apparatus includes an imaging assembly capable of forming an image on a copy sheet; a sheet inverting path disposed downstream of the image assembly and capable of transporting the copy sheet in a first direction; an intermediate tray unit arranged downstream of the sheet inverting path and capable of receiving the copy sheet transferred from the sheet inverting path and stacking a plurality of the copy sheets thereon; and a refeed unit capable of feeding copy sheets stacked on the intermediate tray unit in a second direction opposite to the first direction.

2 Claims, 6 Drawing Sheets

IMAGE FORMING APPARATUS CAPABLE OF DOUBLE-SIDED COPYING AND PROVIDED WITH INTERMEDIATE TRAY ON WHICH FEED DIRECTION OF COPY SHEET IS INVERTED

BACKGROUND OF THE INVENTION

This invention relates to an image forming apparatus used on a copying machine or printer and which is capable of double-sided printing and more particularly, to an intermediate tray portion of an image forming apparatus on which a plurality of copy sheets having been finished with image formation on one side thereof are temporarily stacked in a nipped state for transport of the copy sheets again (refeed of the copy sheets) to conduct image formation on the opposite side thereof.

Conventionally, there has been known copying machines capable of double-sided copying, provided with sheet inverting mechanism including a so-called "switch-back transport path, SB" and intermediate tray portion "IT" (see FIGS. 7A and 7B). In such copying machine, as in FIG. 7A, for the double sided copy, the sheet is inverted after passing through the area of imaging assembly, then the inverted sheet is transferred to the intermediate tray. Thereafter the sheet is moved in the same direction to the imaging assembly to obtain a copy on the side of the copy sheet on which no image formation is completed. Similarly, as in FIG. 7B, for the double sided copy, the sheet is inverted at the switch-back transport path, SB provided upstream of the intermediate tray and the inverted sheet is transferred onto the intermediate tray. Irrespective of the fact that the switch-back transport path "SB" is provided at an upper portion or the lower portion of the image forming apparatus, there is a common feature for these simplified structures of conventional mechanisms that the copy sheet having finished an image formation on one side thereof is inverted before being introduced onto the intermediate tray.

In other words, the sheet inverting mechanism (switch-back transport path) is disposed independently from the intermediate tray portion, i.e., upstream of the intermediate tray portion with respect to sheet transport direction. Thus copy sheets having been finished with an image formation on one side in an imaging assembly are fed to the intermediate tray portion one after another via the sheet inverting mechanism where the sheet transport direction is inverted (i.e., the surface of copy sheet is turned over) so as to execute an image formation on the opposite side of the copy sheets. The copy sheets which are temporarily stacked on the intermediate tray portion after the sheet inverting mechanism are transported again from the intermediate tray portion to the imaging assembly in the same direction that they were transported thereto, upon designation of image formation on the opposite side, thereby executing the image formation on the opposite side in the imaging assembly.

Note that throughout the description, "sheet feed direction" is the direction along which copy sheets are transported until they reach the intermediate tray portion, whereas "sheet refeed direction" is the direction along which they are transported again after being temporarily stacked on the intermediate tray portion.

As mentioned above, in the conventional image forming apparatus, copy sheets stacked on the intermediate tray portion are transported for refeeding in the same direction to the imaging assembly as where they were transported to the intermediate tray portion. In other words, sheets fed to the intermediate tray will not change the direction of movement as they are fed again in the same direction as they were fed to form the image on the other side of the copy sheet to complete the double sided copy.

There has been an increasing demand for image forming apparatus of a smaller size. In producing smaller-sized image forming apparatus, the idea of eliminating the independent switch back transport path is considered to be one of the solutions.

However, there are expected various difficulties to overcome if the above idea is to be adopted such as how the independent switch back transport path is eliminated; where in the sheet refeeding path the switch back transport path is suitably accommodated; which one of the parts in the refeeding path can also function as the switch back transport path.

SUMMARY OF THE INVENTION

It is therefore an object of the invention to overcome the aforementioned difficulties in the conventional technology to eliminate the independent switch back transport path yet enabling the efficient refeed of the copy sheets whose one sides are done with image formation.

One aspect of this invention is to provide an image forming apparatus comprising an imaging assembly capable of forming an image on a copy sheet; a sheet inverting path disposed downstream of the image assembly capable of transporting the copy sheet in a first direction; an intermediate tray unit arranged downstream of the sheet inverting path capable of receiving the copy sheet transferred from the sheet inverting path and stacking a plurality of the copy sheets thereon; and a refeed unit capable of feeding copy sheets stacked on the intermediate tray unit in a second direction opposite to the first direction.

With this arrangement, the copy sheet is movable on the intermediate tray unit in the first direction and the second direction to change its orientation for being ready for the double sided copy. Thus it can eliminate the independent switch-back transport path needed in the conventional apparatus as shown in FIGS. 7A and 7B. As a result of elimination of the independent switch back transport path, the size of the image forming apparatus as a whole can be reduced.

Another aspect of this invention features that the refeed unit includes a nip portion where a lead end of the copy sheets in the second direction is nipped in an aligned state and the intermediate tray unit includes an intermediate tray; a sheet presser for pressingly guiding the copy sheet onto the intermediate tray; and a transport member for transporting the copy sheet on the intermediate tray in the second direction to the nip portion.

With this arrangement, after transported onto the intermediate tray through the sheet inverting path, the copy sheet is fed in the second direction (sheet refeed direction) opposite to the first direction (sheet feed direction) to the nip portion of the refeed portion. At this time, the lead end of the copy sheet is securely held at the nip portion. Thereafter, the copy sheet in the nipped state is refed to the imaging assembly by the refeed portion. Consequently, despite the fact that the sheet refeed direction on the intermediate tray is opposite to the sheet feed direction on the intermediate tray, there can be eliminated an occurrence of undesired phenomenon such as sheet jam. Accordingly, smaller-sized image forming apparatus can be produced, while improving reliability of performance of the apparatus.

Another aspect of the present invention features that the sheet presser is set such that it pressingly guides the copy sheet on the intermediate tray until the copy sheet is transported to the nip portion by the transport member.

With this arrangement, since the sheet presser pressingly guides the upper surface of the copy sheet until at least the lead end of the copy sheet reaches the nip portion, the lead end of the copy sheet can be securely held at the nip portion. Consequently, despite the fact that the sheet refeed direction is opposite to the sheet feed direction on the intermediate tray, there can be eliminated the drawbacks such as sheet jam. Accordingly, smaller-sized image forming apparatus can be produced, while further improving reliability of performance of the apparatus.

Still another aspect of the present invention features that the sheet presser is arranged above the intermediate tray and pivotable up and down to change its posture and pressingly comes into contact with a proximity of an upper surface of the intermediate tray when the copy sheet is transferred from the sheet inverting path.

With this arrangement, when the copy sheet is transported onto the intermediate tray, the sheet presser is retractable to such a position (upward direction) as not to interfere the transport of copy sheet onto the intermediate tray. On the contrary, when the copy sheet is fed in the sheet refeed direction, the sheet presser pivots down to such a position as to pressingly come into contact with the upper surface of the copy sheet on the intermediate tray, thereby feeding the copy sheet on the intermediate tray in the sheet refeed direction with an appropriate pressure.

Yet another aspect of the present invention features that the transport member, arranged above the intermediate tray, having an arm and a roller provided at the free end of the arm, the transport member is set such that the arm being pivotable up and down to set the roller down onto the intermediate tray when the copy sheet is transported to the nip portion in the second direction and the roller being rotatable to apply a feeding force to the copy sheet on the intermediate tray in the second direction to the nip portion.

With this arrangement, when the copy sheet is transported onto the intermediate tray, the roller is retractable to such a position (upward direction) as not to interfere the transport of copy sheet onto the intermediate tray. On the contrary, when the copy sheet is fed in the sheet refeed direction, the arm pivots down to set the roller down onto the copy sheet on the intermediate tray and assuredly transports the copy sheet to the nip portion.

A still further aspect of the present invention features that the intermediate tray unit has a refeed roller capable of applying a feeding force onto a bottom surface of the lowermost copy sheet stacked on the intermediate tray for feeding the lowermost copy sheet into the second direction to the nip portion when the copy sheet was transported from the inverting path.

With this arrangement, the refeed roller—which is in an ordinary sense used to refeed the copy sheets after being stacked on the intermediate tray—applies the feeding force to the bottom surface of the lowermost copy sheet which was just transported through the inverting path on the intermediate tray into the refeed direction to the nip portion. Because of the drive of this refeed roller provided onto the intermediate tray, eliminated is the friction between the refeed roller and the bottom surface of the lowermost copy sheet which would obstruct the movement of the lowermost copy sheet into the refeed direction in case the refeed roller were stationary. Accordingly, the lowermost copy sheet is securely transported to the nip portion before initiation of the copy on the other side of the sheet. As a result, this arrangement leads to prevent the drawbacks that the next copy sheet stacked over the lowermost copy sheet is refed prior to the lowermost copy sheet or that the lowermost and next copy sheets are refed in an overlapped state.

The above and other objects, features and advantages of the present invention will become more apparent upon a reading of the following detailed description and drawings.

DETAILED DESCRIPTION OF THE PREFERRED EMBODIMENTS OF THE INVENTION

Figure 1:
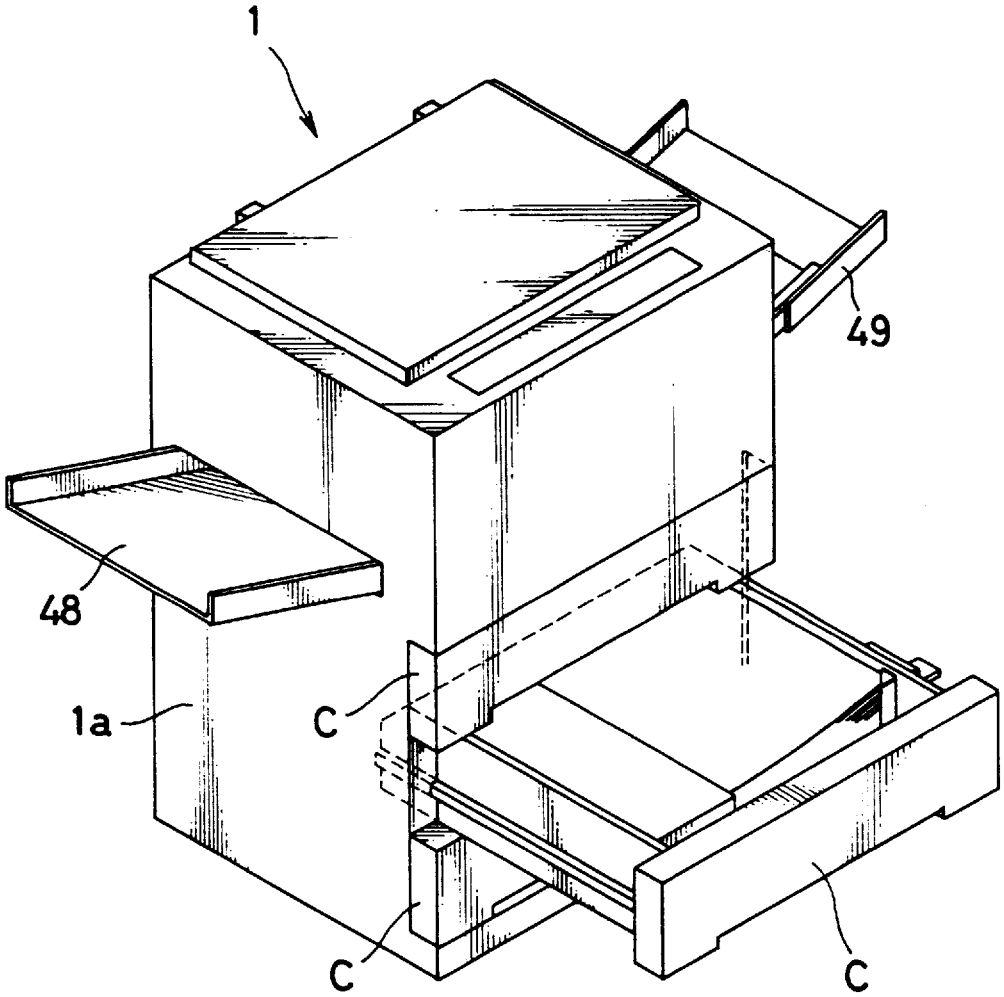
FIG. 1 is an overall perspective view showing a copying machine as an embodiment according to the present invention.
Figure 2A:
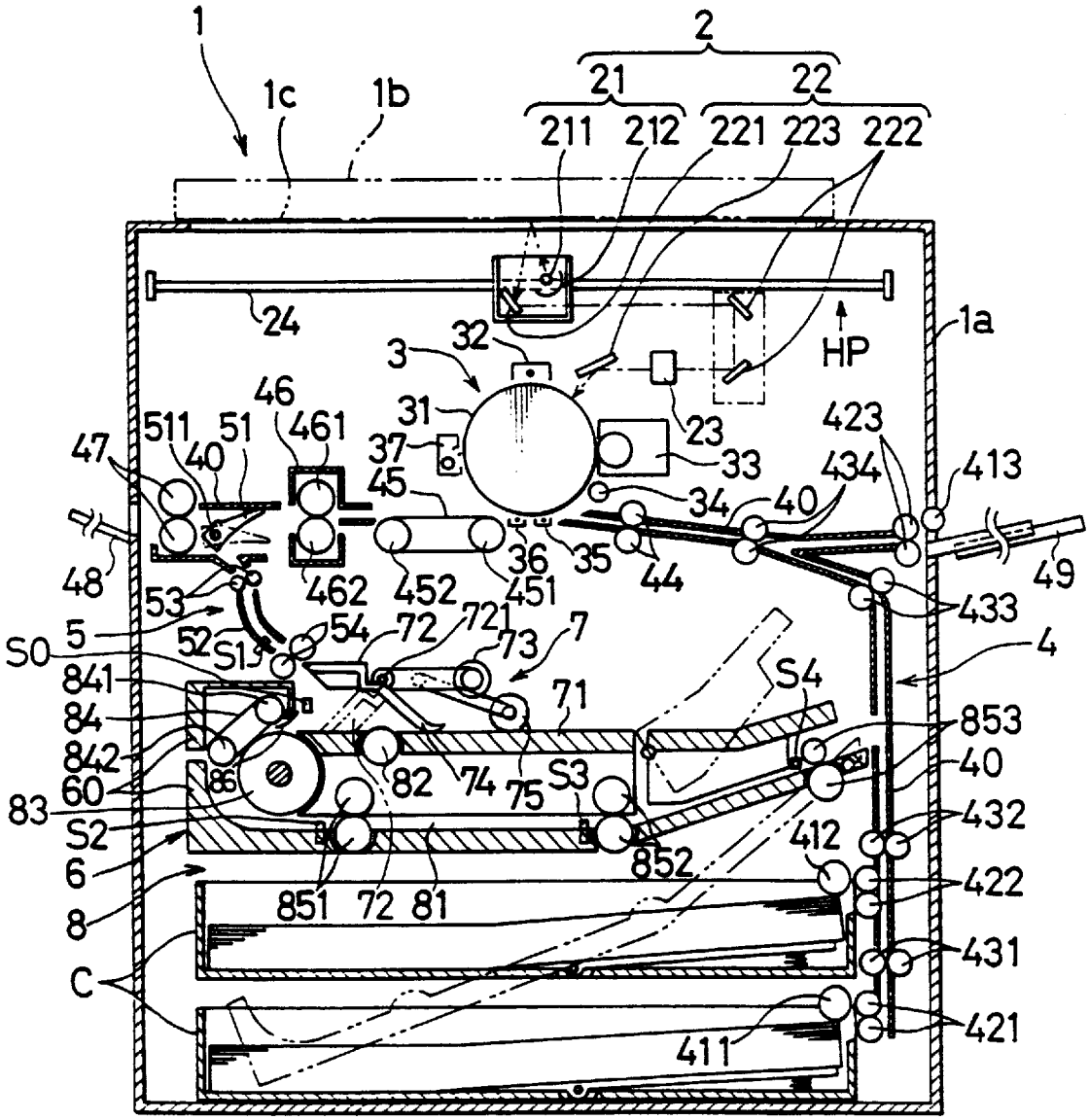
FIG. 2A is a diagram showing an internal arrangement of the copying machine.
Figure 2B:
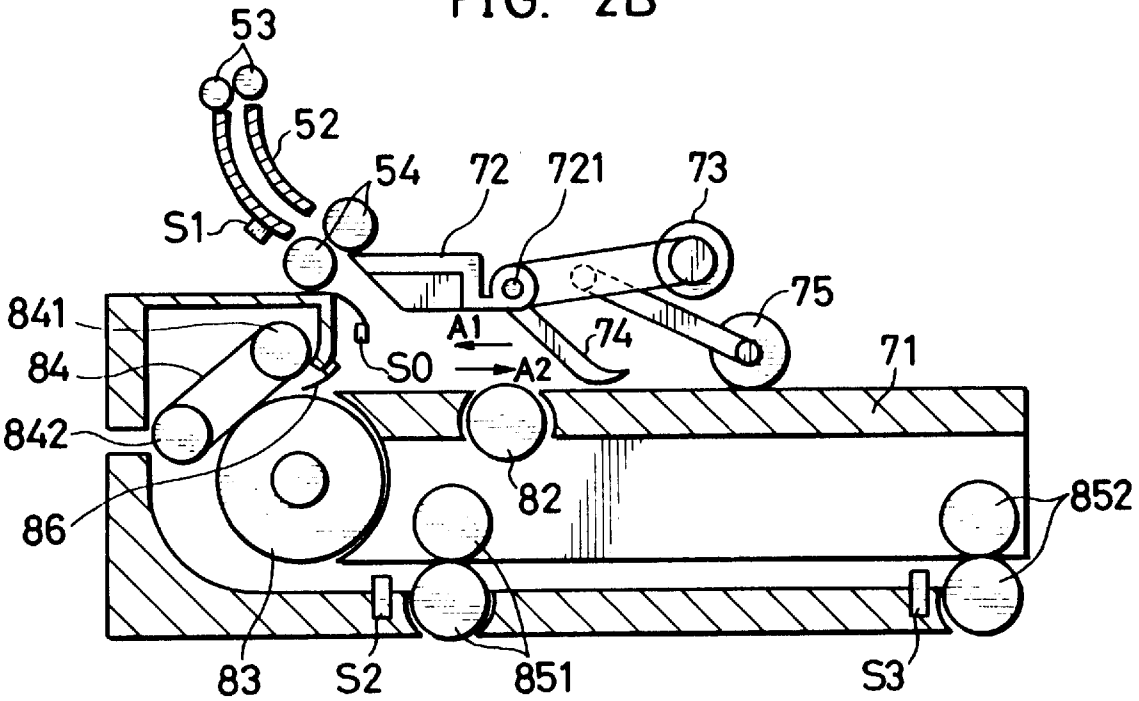
FIG. 2B is a diagram showing a sheet inverting path, an intermediate tray unit and a refeed unit of the internal arrangement of the copying machine.

FIG. 1 is an overall perspective view showing a copying machine, an embodiment of an image forming apparatus according to the present invention. FIGS. 2A and 2B are diagrams showing an internal arrangement of the copying machine.

Reference numeral 1 denotes the copying machine. The copying machine 1 comprises a copying machine main body 1*a* and a document placement portion 1*b* arranged on top of the main body 1*a*. The main body 1*a* comprises an optical assembly 2, an imaging assembly 3 including a photosensitive drum 31, a sheet transport mechanism 4, a sheet inverting mechanism 5, and a duplex copy unit 6.

The document placement portion 1*b* includes a contact glass 1*c* and a document presser. When a document is manually placed on the contact glass 1*c* mounted at the top of the copying machine main body 1*a* and the document presser covers the contact glass 1*c*, the document is securely placed between the contact glass 1*c* and the document presser. Alternatively, the document placement portion 1*b* may be provided with an automatic document feeder arranged on an upper portion of the contact glass 1*c*. With such automatic document feeder, documents stacked on the document feeder are automatically fed one after another onto a specified exposure position of the contact glass 1*c* where a document image is read, and are discharged one after another after the image reading.

The optical assembly 2 comprises a first optical portion 21, second optical portion 22, a focus lens 23, a pair of guide rails 24, 24 (in FIG. 2A, only one rail 24 is shown), and an unillustrated optical assembly drive mechanism. The first optical portion 21 includes a light source 211 such as a halogen lamp which reciprocally scans a document image placed on the contact glass 1*c* within a predetermined area from a home position HP (document reference position) and to a specified position, and a reflected mirror 212. The second optical portion 22 includes a plurality of reflected mirrors, such as mirrors 221 and 222 both of which introduce a light image of the document image projected by light emitted from the light source 211 to the imaging assembly 3. The lens 23 is adapted for focusing the light image onto the surface of the photosensitive drum 31. The guide rails 24, 24 are adapted for reciprocally moving the first and second optical portions 21, 22 in sideways directions (shown by the arrows in FIGS. 2A & 2B). The optical assembly drive mechanism is adapted for driving the first and second optical portions 21 and 22 at respective specified speeds along the guide rails 24, 24. A reflected mirror 223 introduces the light image passing through the lens 23 to a specified exposure position on the photosensitive drum surface at which the light image is to be exposed.

As mentioned above, light emitted from the light source 211 is projected to an image of a document placed on the contact glass 1*c* to obtain a light image. The light image is reflected by the reflected mirrors 212, 221, and 222, as shown by the broken line in FIG. 2A, and via the lens 23 is guided to the specified exposure position on the drum surface by way of the reflected mirror 223.

The imaging assembly 3 includes a photosensitive drum 31 which is rotated in the clockwise direction at a constant speed by an unillustrated drum drive mechanism. The imaging assembly further comprises a main charger 32, developing unit 33, toner recovery portion 34, transfer portion 35, separation portion 36, and cleaning unit 37 in a periphery of the photosensitive drum 31 in the rotating direction thereof in this order. After being uniformly charged by the main charger 32, the surface of the photosensitive drum 31 is exposed to form an electrostatic latent image thereon. Toner supplied from the developing unit 33 is electrically attracted to the latent image to develop the latent image into a toner image. Subsequently, the toner image is transferred onto a copy sheet by the transfer portion 35. Then, the copy sheet carrying the toner image is separated from the surface of the photosensitive drum 31 by the separation portion 36 and transported to a fixing portion 46.

The sheet transport mechanism 4 includes a plurality of cassettes C (in FIG. 2A, two cassettes are shown), each of which is detachably mounted to a lower portion of the copying machine main body 1*a* and are arranged vertically one over another. Each cassette is adapted for containing copy sheets of a specified size in a stacked state therein.

The sheet transport mechanism 4 further comprises a sheet transport guide portion 40, feed rollers 411, 412 for dispensing copy sheets in the cassette one by one from upstream side of the sheet transport direction, separation roller pairs 421, 422 for preventing multi-feed of copy sheets, transport roller pairs 431 to 434, and a registration roller pair 44 for transporting the copy sheet being fed in timed relation with an image formation.

The sheet transport mechanism 4 further comprises a transport belt 45 which is stretched around belt rollers 451 and 452, fixing portion 46, sheet discharge roller pair 47, sheet discharge tray 48 on the downstream side of the rotating direction of the photosensitive drum 31. The sheet transport mechanism 4 further comprises a manual insertion tray 49 on the upstream side of the rotating direction of the photosensitive drum 31. The manual insertion tray 49 is adapted for manually placing copy sheets of a specified size thereon, and includes a feed roller 413 and separation roller pair 423. The sheet transport guide portion 40 is adapted for guiding a copy sheet transported by the separation roller pairs 421, 422 toward the sheet discharge roller pair 47, and comprises plate members disposed in parallel to each other spaced apart by a specified distance to guide the copy sheet therebetween. The plate members define a sheet transport path. A copy sheet fed inside the copying machine main body 1*a* through the manual insertion tray 49 is transported toward the sheet discharge roller pair 47 along the sheet transport path.

The fixing portion 46 includes a heater roller 461 and a presser roller 462. The heater roller 461 is internally provided with a heater, while the presser roller 462 is pressed against the heater roller 461 at a certain pressure.

A copy sheet dispensed from one of the cassettes C or inserted through the manual insertion tray 49 by one of the feed rollers 411 to 413 is fed to the registration roller pair 44 via one of the transport roller pairs 431 to 434. Then, the copy sheet is transported in timed relation with a timing of exposure and scanning by the optical mechanism 2 to transfer a toner image formed on the surface of the photosensitive drum 31 onto the copy sheet by the transfer portion 35. The copy sheet carrying the toner image is transported to the fixing portion 46 by way of the transport belt 45, where the toner image is fixed on the copy sheet, and discharged to the sheet discharge tray 48 by the sheet discharge roller pair 47.

The sheet inverting mechanism 5 includes a switching member 51 which is arranged at a specified position along the sheet transport path between the fixing portion 46 and sheet discharge roller pair 47. The switching member 51 is pivotally rotated about a horizontal pivot 511 by an unillustrated electromagnetic solenoid to changeably direct the copy sheet being transported along the sheet transport path toward the sheet discharge roller pair 47 (to thereby enable single-sided copying) or toward the duplex copy unit 6 (to thereby enable double-sided copying).

The sheet inverting mechanism 5 further comprises a sheet inverting guide 52, inlet transport roller pair 53 disposed at an inlet of the sheet inverting guide 52, and outlet transport roller pair 54 disposed at a downstream end (outlet) of the sheet inverting guide 52. The sheet inverting guide 52 includes curved guide plates opposingly disposed to each other spaced apart by a specified distance to guide a copy sheet toward the duplex copy unit 6. These guide plates define a sheet inverting path.

With this arrangement, a copy sheet whose transport direction is selectively changed toward the duplex copy unit 6 is transported downstream along the sheet inverting path, while a warp of the copy sheet caused at the fixing portion 46 is corrected. Thereby, the copy sheet is guided to the outlet transport roller pair 54 in a substantially flat state.

A sheet sensor S1 is arranged at a specified position just upstream of the outlet transport roller pair 54 to detect the presence or absence of a copy sheet passing through the sheet inverting path.

The duplex copy unit 6 is operable to effect double-sided copying, and comprises an intermediate tray unit 7 including a unit main body 60 and a refeed mechanism 8. It should be noted that the refeed of copy sheets throughout the embodiment means transport of copy sheets again after having been temporarily stacked on the intermediate tray unit 7 for image formation on the opposite side of the copy sheets.

The refeed mechanism 8 includes a refeed guide portion 81, a refeed roller 82, an inverting roller 83, a separation belt 84, and refeed roller pairs 851 to 853. The refeed guide portion 81 includes plate members opposingly disposed to each other spaced apart by a specified distance to guide the copy sheet therebetween. The refeed roller 82 is disposed on the left side in FIGS. 2A & 2B and has an upper circumferential portion exposed upward from the intermediate tray 71. The intermediate tray 71 will be described later in more detail.

The inverting roller 83 is arranged further on the left side of the refeed roller 82 in FIGS. 2A & 2B. The separation belt 84 is stretched between belt rollers 841 and 842, and is rotated in a direction agreeing with the sheet refeed direction in contact state with a circumferential surface of the inverting roller 83. Note that the sheet refeed direction along which a copy sheet on the intermediate tray 71 is to be transported toward the inverting roller 83 is shown by the arrow A1 in FIGS. 2A & 2B, while the sheet feed direction along which the copy sheet is to be transported onto the intermediate tray 71 after the sheet inverting guide 52 is shown by the arrow A2 in FIGS. 2A & 2B.

The refeed roller pairs 851 to 853 are arranged at an appropriate intervals from one another in the refeed guide portion 81. When the refeed roller pairs 851 to 853 are driven, the copy sheet is refed along the sheet refeed path toward the imaging assembly 3 through the refeed guide portion 81.

Note that the sheet refeed path is represented by the arrows in FIG. 2A as follows:

Refeed roller 82 → inverting roller 83 → refeed roller pair 851, 851 → refeed roller pair 852, 852 → and refeed roller pair 853, 853

At a nip position where a copy sheet is to be nipped between the belt roller 841 and the inverting roller 83, there is arranged a flexible sheet member 86 which droops downward from the unit main body 60. The sheet member 86 has a lower end thereof substantially coming into contact with the inverting roller 83. Sheet sensors S2, S3, and S4 are arranged upstream of the refeed roller pairs 851, 852, and 853 respectively to detect the presence or absence of copy sheet passing along the sheet refeed path through the refeed guide portion 81.

Hereinafter, the intermediate tray unit of the present invention is described in detail. The intermediate tray unit 7 includes the intermediate tray 71 on which copy sheets being transported in the duplex copy unit 6 are to be stacked, a sheet presser 72, a nip roller (drive roller) 73, a sheet guide 74, and a rotary member 75. The sheet presser 72 is disposed above the intermediate tray 71 and is rotatably supported about a pivot 721. The nip roller 73 is also rotatably supported about the pivot 721. The rotary member 75 comes into contact with the uppermost copy sheet of the stacked copy sheets by its weight and is rotatably driven together with the copy sheet in the refeed movement.

Each time when a copy sheet is transported onto the intermediate tray 71 by the outlet transport roller pair 54, the sheet presser 72 is pivotally rotated downward to pressingly come into contact with the trail end of the copy sheet in the sheet feed direction (i.e., the lead end of the copy sheet in the sheet refeed direction). The nip roller 73 has an outer surface made of an elastic material such as rubber. Each time when the copy sheet is transported onto the intermediate tray 71, the nip roller 73 is pivotally rotated downward about the pivot 721 to pressingly come into contact with the copy sheet with a specified pressure, while driven to transport the copy sheet in the sheet refeed direction to the nip position between the inverting roller 83 and sheet member 86. The sheet presser 72 guides the copy sheet on the intermediate tray 71 until the lead end of the copy sheet is fed to the nip position by the nip roller 73. In this way, the copy sheets are stacked on the intermediate tray 71 with the lead end thereof securely aligned in a nipped state. Whether the copy sheet has been transported to the nip position in an aligned state is monitored by an unillustrated rotary encoder provided on a rotary shaft of the rotary member 75.

After it is confirmed that the designated number of copy sheets are stacked on the intermediate tray 71 with the lead end thereof aligned in a nipped state, and the apparatus is instructed to effect image formation on the opposite side of the copy sheets the refeed roller 82, inverting roller 83, and separation belt 84 are started to be driven. In this state, the copy sheets are fed one after another from the lowermost copy sheet with a pressing force applied by the sheet presser 72 from above, and are successively guided along the sheet refeed path in the refeed guide portion 81 to the imaging assembly 3 where an image formation is conducted on the opposite side of the copy sheets. After the image formation on the opposite side, the copy sheets are discharged onto the sheet discharge tray 48 by the sheet discharge roller pair 47.

Figure 3:
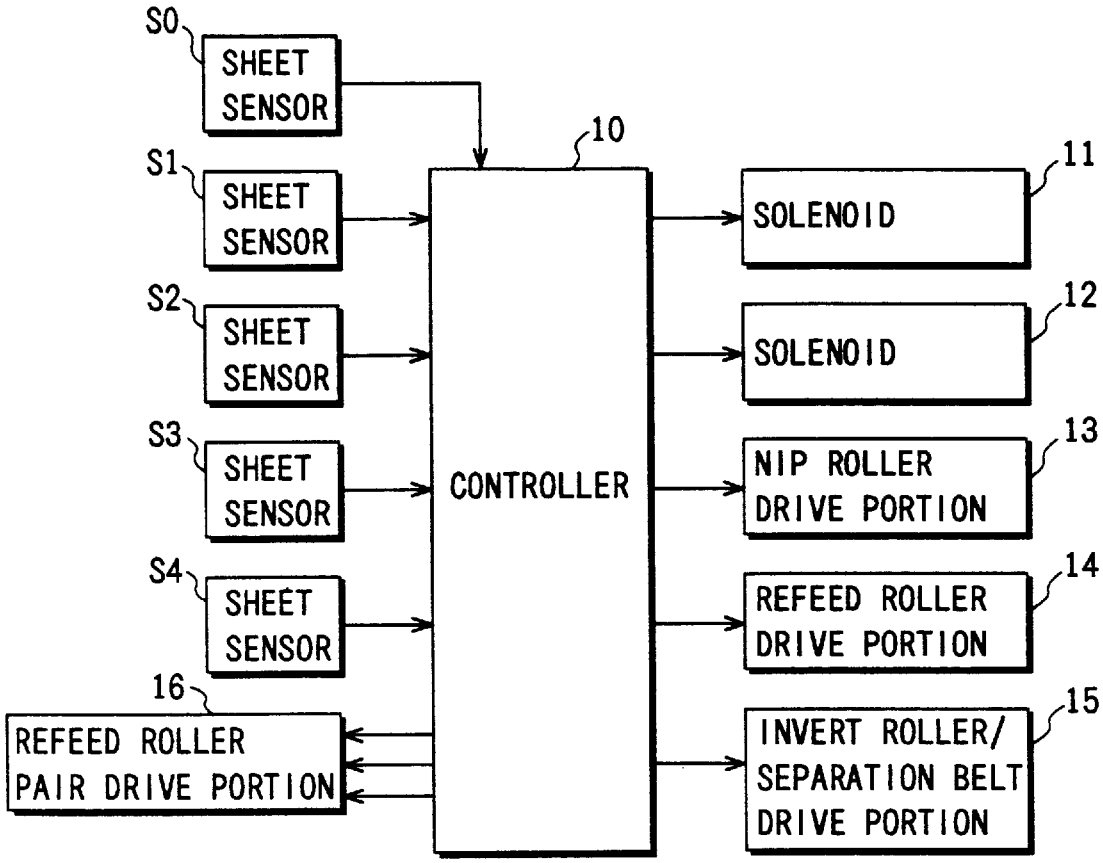
FIG. 3 is a block diagram showing various elements in a duplex copy unit of the copying machine.

FIG. 3 is a block diagram showing control operations of each element in the duplex copy unit 6.

In FIG. 3, the reference numeral 10 denotes a controller. The controller 10 includes, e.g., a microcomputer, and controls overall operations of the copying machine. The controller 10 outputs a drive signal to the respective elements based on a detection signal from the sheet sensors S0 to S4. The reference numeral 11 denotes a solenoid for the switching member 51 so as to changeably direct the switching member 51 to a specified direction (downward) so as to transport copy sheets toward the sheet discharge roller pair 47 or to the other direction (upward) so as to transport the copy sheets toward the sheet inverting guide 52.

Specifically, when the duplex copy mode is selected to conduct double-sided copying for the designated number of copy sheets, and an unillustrated sheet sensor detects that a first copy sheet having been finished with an image formation on one side passes a specified position, e.g., fixing portion 46, the solenoid 11 is operated to changeably direct the switching member 51 upward to transport the copy sheet toward the sheet inverting guide 52. Then, the solenoid 11 is changeably directed downward to discharge the designated number of copy sheets toward the sheet discharge roller pair 47 when the sheet sensor detects that the first copy sheet having been finished with an image formation on the opposite side passes the fixing portion 46.

The reference numeral 12 denotes a solenoid for the sheet presser 72. The solenoid 12 is adapted for pivotally rotating the sheet presser 72 about the pivot 721 downward to pressingly come into contact with the trail end of the copy sheet in the sheet feed direction, each time the copy sheet is transported onto the intermediate tray 71. The reference numeral 13 denotes a nip roller drive portion 13 which includes a motor for driving the nip roller 73 to transport the copy sheet on the intermediate tray 71 to the nip position. The sheet sensor SO is arranged at the nip position to detect that the copy sheet has reached the nip position (see FIGS. 2A & 2B).

The reference numeral 14 denotes a refeed roller drive portion which includes a motor for driving the refeed roller 82 upon designation of refeed of copy sheets. The reference numeral 15 denotes an inverting roller/separation belt drive portion which includes a motor for driving the inverting roller 83 and separation belt 84 for a specified duration upon designation of refeed of copy sheets. The reference numeral 16 denotes a refeed roller pair drive portion which includes a motor for driving the refeed roller pairs 851 to 853 for a specified duration upon receipt of detection signal from the sheet sensors S2 to S4.

Next, operations of the duplex copy unit 6 will be described with reference to FIGS. 4 and 5.

Figure 4:
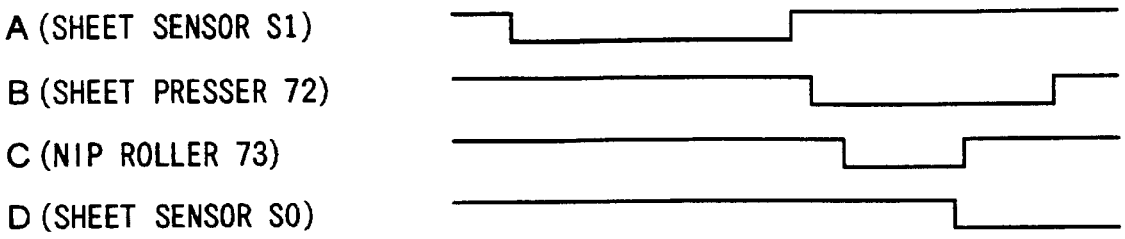
FIG. 4 is a timing chart showing ON/OFF states of each element in the duplex copy unit when copy sheets are stacked in the duplex copy unit.

Operations on how copy sheets, transported through the inverting path 52, are stacked on the intermediate tray 71 are briefly described referring to FIG. 4.

When an original document is placed on the document placement portion 1*b* and duplex copy mode is designated, the first optical portion 21 is slidably moved along the guide rails 24, 24 at a specified speed to expose a light image of a document image on the surface of the photosensitive drum 31. A copy sheet dispensed from one of the cassettes C or manually inserted through the insertion tray 49 is transported to the imaging assembly 3 by the registration roller pair 44 in synchronism with an exposure/scanning timing of the optical assembly 2. In the imaging assembly 3, toner is electrically attracted to the light image on the surface of the photosensitive drum 31 to form a toner image on the drum surface. The toner image is transferred onto the copy sheet being transported to the imaging assembly 3 by the transfer portion 35. The copy sheet carrying the toner image is separated by the separation portion 36, and transported to the fixing portion 46 by the transport belt 45, where the toner image on the copy sheet is fused and fixed to obtain a fixed toner image, while the copy sheet passing between the heater roller 461 and presser roller 462. Then, the copy sheet carrying the fixed toner image is transported toward the switching member 51.

The switching member 51 is changeably directed upward by an activation of solenoid 11 to direct the copy sheet toward the sheet inverting guide 52. Thereby, the copy sheet is transported to the sheet inverting guide 52 with a warp of the copy sheet being straightened by the transport roller pair 53, and passes the sheet sensor S1 (shown by the signal A in FIG. 4). When the copy sheet passes the outlet roller pair 54 and is transported onto the intermediate tray 71, the solenoid 12 is activated to rotate the sheet presser 72 downward (shown by the phantom line in FIG. 2A). Thereby, the sheet presser 72 comes into press contact with the trail end of the copy sheet in the sheet feed direction to reliably place the copy sheet on the intermediate tray 71 (shown by the signal B in FIG. 4).

Then, when the nip roller drive portion 13 is activated to swing the nip roller 73 downward and rotatably drive the same (shown by the signal C in FIG. 4), the copy sheet is transported in the sheet refeed direction so that the trail end of the copy sheet (i.e., the lead of the copy sheet in the sheet refeed direction) reaches the nip position between the sheet member 86 and inverting roller 83, with the pressing force and rotating force of the nip roller 73 being applied thereto.

When the copy sheet is nipped between the sheet member 86 and inverting roller 83 with a specified pressure, the sheet sensor S0 detects that the copy sheet has reached the nip position (shown by the signal D in FIG. 4). Upon detection by the sheet sensor S0, the rotation of the nip roller 73 is suspended. In this manner, the copy sheets transported to the duplex copy unit 6 are stacked on the intermediate tray 71 one after another with the lead end of the copy sheets in the sheet refeed direction being aligned in a nipped state.

Note that in the case where the sheet presser 72 is pivotally rotated downward in the absence of copy sheet on the intermediate tray 71, the lower end of the sheet presser 72 falls onto a position in nearest contact with the upper surface of the intermediate tray 71.

Next, operations on how copy sheets which had been stacked over the intermediate tray 71 are refed along the sheet refeed path will be briefly described with reference to FIG. 5.

Figure 5:
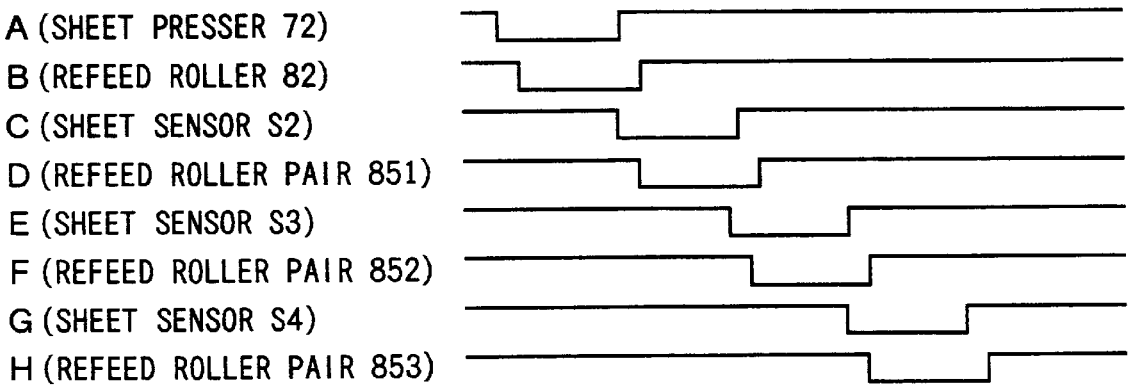
FIG. 5 is a timing chart showing ON/OFF states of each element in the duplex copy unit when the copy sheets are refed in the duplex copy unit.

When image formation on the opposite side of the copy sheets is selected, the sheet presser 72 slidably guides the copy sheets stacked on the intermediate tray 71 (shown by the signal A in FIG. 5). In this state, the refeed roller drive portion 14 is activated to drive the refeed roller 82 (shown by the signal B in FIG. 5) so as to transport the stacked copy sheets from the lowermost copy sheet one by one toward the sheet inverting roller 83. The inverting roller/separation belt drive portion 15 is activated in synchronism with the rotation of refeed roller 82 to drive the inverting roller 83 and separation belt 84, thereby transporting the copy sheets in the nipped state in the sheet refeed direction one by one toward the refeed guide portion 81 by the sheet inverting roller 83 and separation belt 84.

Then, the refeed roller pair drive portion 16 is activated to rotate the refeed roller pair 851 (shown by the signal D in FIG. 5) when the sheet sensor S2 detects the copy sheet (shown by the signal C in FIG. 5); rotate the refeed roller pair 852 (shown by the signal F in FIG. 5) when the sheet sensor S3 detects the copy sheet (shown by the signal E in FIG. 5); and rotate the refeed roller pair 853 (shown by the signal H in FIG. 5) when the sheet sensor S4 detects the copy sheet (shown by the signal G in FIG. 5), in this order respectively. Thereby, after being transported along the sheet refeed path in the refeed guide portion 81, the copy sheet has an image formed on the opposite side thereof in the imaging assembly 3, and transported toward the switching member 51 via the fixing portion 46. By the time when the first (lowermost) copy sheet having an image formed on the opposite side passes the fixing portion 46, the switching member 51 changes its posture in such a direction as to discharge the copy sheet toward the discharge roller pair 47, thereby discharging the copy sheet onto the sheet discharge tray 48 by the discharge roller pair 47.

With this arrangement, even in the case where the copy sheets stacked on the intermediate tray 71 are to be transported in the sheet refeed direction opposite to the sheet feed direction for refeed of copy sheets, the copy sheets are reliably transported to the refeed guide portion 81 from the intermediate tray 71. Thereby, eliminated is the drawback such as copy sheet jam in the duplex copy unit 6.

Further, since refeed of copy sheets is monitored by the rotary member 75, there can be immediately detected the abnormality of refeed of copy sheets by the nip roller 73. Thereby, the copy sheets can be reliably stacked on the intermediate tray unit 7 with the lead end thereof aligned in a nipped state.

In the foregoing embodiment, the copy sheets having been transported onto the intermediate tray 71 through the sheet inverting path are transported one after another in the sheet refeed direction to the nip position by the drive of nip roller 73.

Alternatively, the first copy sheet to be stacked on the intermediate tray 71 (i.e., the lowermost copy sheet of the stacked copy sheets) may be transported to the nip position by driving the refeed roller 82 in a counterclockwise direction to transport the copy sheet toward the nip position), in conjunction with the rotation of the nip roller 73. Note that the refeed roller 82 is in its ordinary sense used to feed the copy sheets stacked on the intermediate tray 71 whose leading ends are aligned at the nip portion to the refeeding direction.

Figure 6:
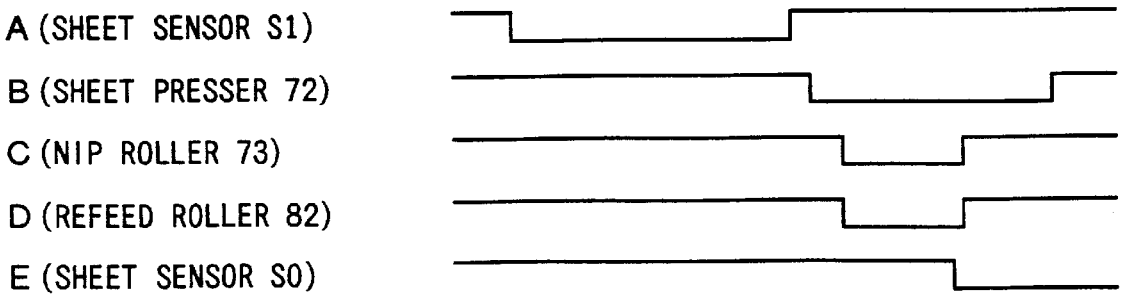
FIG. 6 is a timing chart showing ON/OFF states of each element in the duplex copy unit operated in a manner different from FIG. 4.
Figure 7A:
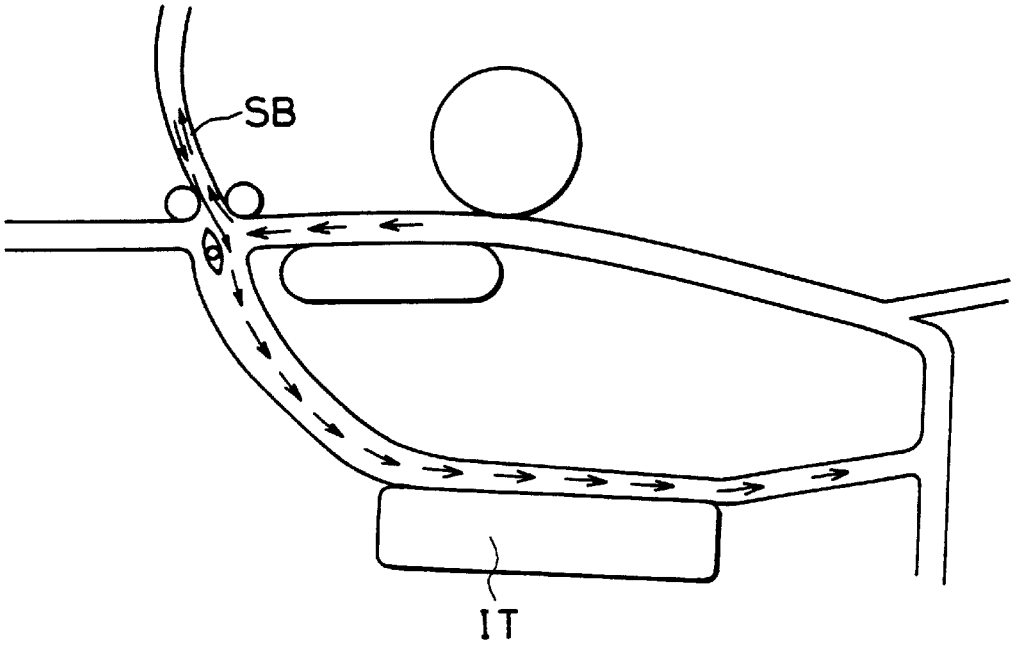
PRIOR ART FIG. 7A
FIGS. 7A and 7B are simplified diagrams each showing a conventional arrangement of an intermediate tray portion and sheet inverting mechanism.
Figure 7B:
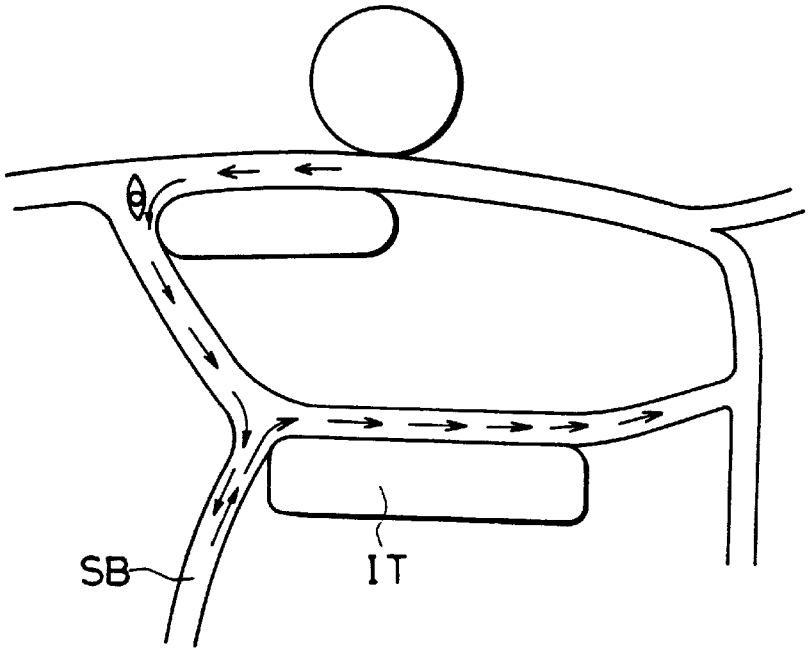
PRIOR ART FIG. 7B

Thus, by driving the nip roller 73 and refeed roller 82 at the same timing as shown in FIG. 6 (see signals C & D), the first copy sheet having been transported onto the intermediate tray 71 can be assuredly transported to the nip position, avoiding the resistance force which would have been generated between the refeed roller 82 and the bottom surface of lowermost copy sheet on the intermediate tray 71 if the refeed roller 82 were stationary.

It would be easier to understand the effect of this movement of the roller 82 by imagining what would happen in case that the refeed roller 82 was stationary. If the refeed roller 82 was stationary when the copy sheet is being forwarded to the nip position, then the feed force to move the sheet to the nip position has to solely depend on the nip roll 73. However, the drive of nip roller 73 may not always be sufficient enough to overcome the resistance force generated due to the friction between the stationary refeed roller 82 and the bottom surface of the copy sheet. Thus, driving the refeed roller 82 into the counterclockwise direction certainly helps the movement of the lowermost copy sheet to the nip position. From the second copy sheet placed over the lowermost copy sheet which had been already fed to the nip position, moving the respective sheet to the nip position can be carried out by the drive of the nip roller 73 since the sheet slides over the copy sheet with significantly smaller frictional force compared to the frictional force generated between the stationary refeed roller 82 and the lowermost copy sheet.

As a result, it would certainly contribute to reduce the possibility of occurrence that the next copy sheet stacked over the lowermost copy sheet is transported to the nip position prior to the lowermost copy sheet due to the relatively greater frictional resistance between the lowermost copy sheet and the refeed roller 82. In addition, it would also contribute to reduce the possibility of occurrence that the lowermost and next copy sheets are transported in the sheet refeed direction in an overlapped state.

Specifically, when the first copy sheet passes the sheet sensor S1 (shown by the signal A in FIG. 6) and is transported onto the intermediate tray 71, the solenoid 12 is activated to pivotally swing the sheet presser 72 downward, thereby placing the copy sheet on the intermediate tray 71 with a specified pressure (shown by the signal B in FIG. 6). In this state, the nip roller drive portion 13 is activated to swing the nip roller 73 downward and drivingly rotate the same (shown by the signal C in FIG. 6). At the same time when the nip roller drive portion 13 is activated, the refeed roller drive portion 14 is activated to drive the refeed roller 82 (shown by the signal D in FIG. 6)., Thereby, the lead end of the first copy sheet is reliably fed to the nip position between the sheet member 86 and inverting roller 83. Upon reaching the nip position, the copy sheet has its presence detected by the sheet sensor S0 (shown by the signal E in FIG. 6). Then, the driving of nip roller 73 and refeed roller 82 is suspended. Thereafter, the rest of the copy sheets coming after the first copy sheet into the intermediate tray unit 7 are successively stacked on the intermediate tray 71 with the lead end thereof also aligned at the specified position (nip position). Thereby, refeed of copy sheets for image formation on the opposite side can be conducted reliably.

In the foregoing embodiment, the present invention is described with reference to an image forming apparatus provided with the duplex copy unit. However, the present invention is applicable to any image forming apparatus such as one with an intermediate tray portion adapted for copying images different from one another on a plurality of copy sheets on one side thereof, respectively.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A image forming apparatus comprising:

an image assembly forming an image on a copy sheet;

a sheet inverting path disposed downstream of the image assembly transporting the copy sheet in a first direction;

an intermediate tray unit arranged downstream of the sheet inverting path receiving the copy sheet from the sheet inverting path and stacking a plurality of the copy sheets on the intermediate tray unit;

a sheet presser having a sheet pressure support disposed on the intermediate tray unit and movable mounting said sheet presser for movement in a vertical direction for pressing an end portion of the copy sheet that has been transported from the sheet inverting path against a surface of the intermediate tray unit;

a feed roller support supporting a feed roller in a position disposed downstream of the sheet presser and above the intermediate tray unit, said feed roller support being movable in a vertical direction for causing the feed roller to abut against the portion of the copy sheet other than said end portion to feed the copy sheet;

a refeed unit for feeding copy sheets stacked on the intermediate tray unit in a second direction opposite to the first direction; and a refeed roller disposed between the sheet presser and the feed roller for feeding the copy sheet from the intermediate tray unit to the refeed unit in cooperation with the feed roller and for refeeding the copy sheet to the image assembly in cooperation with the refeed unit.

2. An image forming apparatus comprising:

an image assembly forming an image on a copy sheet;

a sheet inverting path disposed downstream of the image assembly transporting the copy sheet in a first direction;

an intermediate tray unit arranged downstream of the sheet inverting path receiving the copy sheet from the sheet inverting path and stacking a plurality of the copy sheets on the intermediate tray unit;

a sheet presser having a sheet presser support disposed on the intermediate tray unit and movable mounting said sheet presser for movement in a vertical direction for pressing an end portion of the copy sheet that has been transported from the sheet inverting path against a surface of the intermediate tray unit;

a feed roller support supporting a feed roller in a position disposed downstream of the sheet presser and above the intermediate tray unit, said feed roller support being movable in a vertical direction for causing the feed roller to abut against the portion of the copy sheet other than said end portion to feed the copy sheet;

a refeed unit for feeding copy sheets stacked on the intermediate tray unit in a second direction opposite to the first direction; and a refeed roller disposed between the sheet presser and the feed roller for contacting a portion of the copy sheet transported to the refeed unit by the feed roller and for refeeding the copy sheet to the image assembly in cooperation with the refeed unit.

* * * * *